United States Patent [19]

Lo

[11] Patent Number: 5,076,573

[45] Date of Patent: Dec. 31, 1991

[54] MAGNETIC RESISTANCE TYPE STATIONARY ROWING UNIT

[76] Inventor: Peter K. Lo, P.O. Box 13-124, Taipei, Taiwan

[21] Appl. No.: 659,737

[22] Filed: Feb. 22, 1991

[51] Int. Cl.[5] ..... A63B 21/00; A63B 69/06

[52] U.S. Cl. ..... 272/72; 272/129

[58] Field of Search ..... 272/72, 73, 129

[56] References Cited

U.S. PATENT DOCUMENTS

| | | | |
|---|---|---|---|
| 4,736,944 | 4/1988 | Johnson et al. | 272/72 |
| 4,798,378 | 1/1989 | Jones | 272/72 |
| 4,822,032 | 4/1989 | Whitmore et al. | 272/129 |

FOREIGN PATENT DOCUMENTS

| | | | |
|---|---|---|---|
| 1279201 | 6/1971 | United Kingdom | 272/73 |

*Primary Examiner*—Stephen R. Crow

[57] ABSTRACT

A magnetic resistance type exercise unit includes a frame assembly, a first rotating shaft journaled on the frame assembly, a rope sheave rotatably actuating the first rotating shaft, a rope wound around the rope sheave and having one end secured to the rope sheave, a handle secured to the other end of the rope so as to rotate the rope sheave by pulling the rope away from the rope sheave, a spiral spring connected to the rope sheave to rewind the rope about the rope sheave, a second rotating shaft journaled on the frame assembly and rotated by the first rotating shaft, a rotary plate rigidly sleeved on the second rotating shaft and made of an electrical conducting material, and a permanent magnet member mounted on the frame assembly adjacent to the rotary plate and having a pair of oppositely polarized and aligned ends disposed on opposite sides of the rotary plate. When in use, the rotary plate cuts into a nonuniform magnetic field caused by the permanent magnet member to thereby induce eddy currents in the rotary plate. The eddy currents induced in the rotary plate generate a retarding force that opposes the motion of the rotary plate through the magnetic field.

12 Claims, 4 Drawing Sheets

MAGNETIC RESISTANCE TYPE STATIONARY ROWING UNIT

BACKGROUND OF THE INVENTION

1. Field Of The Invention

The invention relates to an exercise device, more particularly to a magnetic resistance type stationary rowing unit.

2. Description Of The Related Art

Wind-drag type stationary rowing units are known in the art. This type of stationary rowing unit usually includes a flywheel having a plurality of fan-type blades. A handle is connected to the flywheel and propels the flywheel when pulled. When the flywheel rotates, the blades encounter air resistance which tends to decelerate the flywheel.

Some of the disadvantages of the wind-drag type stationary rowing unit are as follows:

1. The air resistance encountered is proportional to the rotation of the flywheel. Thus, rowing must be done at a faster pace to increase the angular speed of the flywheel to correspondingly increase the air resistance.

2. Conventional wind-drag type stationary rowing units in which a wide range of resistance can be achieved without rowing at a faster pace are complicated, bulky and expensive.

3. The conventional wind-drag type stationary rowing units incorporate a drive chain which makes a lot of noise.

4. Because the rowing action results in repeated and sudden tension between the drive chain and a sprocket coupled with the flywheel, the lifetime of the drive chain is reduced and noise is increased.

SUMMARY OF THE INVENTION

Therefore, the main objective of the present invention is to provide a magnetic resistance type stationary rowing unit which overcomes the drawbacks associated with conventional stationary rowing units.

Accordingly, the preferred embodiment of a magnetic resistance type stationary rowing unit according to the present invention comprises a frame assembly, a manually operated unit, a magnetic resistance generating means, and an endless driving means. The frame assembly includes a substantially horizontally extending body, a wheel support mounted on a front end of the body, a seat slidably mounted on the body, and a pair of foot rests secured on the body inward from the seat. The manually operated unit includes a first rotating shaft journaled on the wheel support, a rope sheave rotatably actuating the first rotating shaft and having a helical groove in the rope sheave, a spiral spring connected to the rope sheave, a rope wound around the rope sheave along the helical groove and having one end secured to the rope sheave, and a handle secured to the other end of the rope. Pulling the rope away from the rope sheave thus rotates the rope sheave against the action of the spiral spring, and relieving the pulling force on the rope allows the spiral spring to rewind the rope onto the rope sheave. The magnetic resistance generating means includes a second rotating shaft journaled on the frame assembly, a rotary plate rigidly sleeved on the second rotating shaft and made of an electrical conducting material, and a permanent magnet member mounted on the frame assembly adjacent to the rotary plate and having a pair of oppositely polarized and aligned ends disposed on either side of the rotary plate. The endless driving means transfers rotation of the first rotating shaft to the rotary plate. When in use, the rotary plate cuts into a nonuniform magnetic field caused by the permanent magnet member to thereby induce eddy currents in the rotary plate. The eddy currents induced in the rotary plate generate a retarding force that opposes the motion of the rotary plate through the magnetic field. The position of the permanent magnet member relative to the rotary plate is adjustable to correspondingly vary the retarding force.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
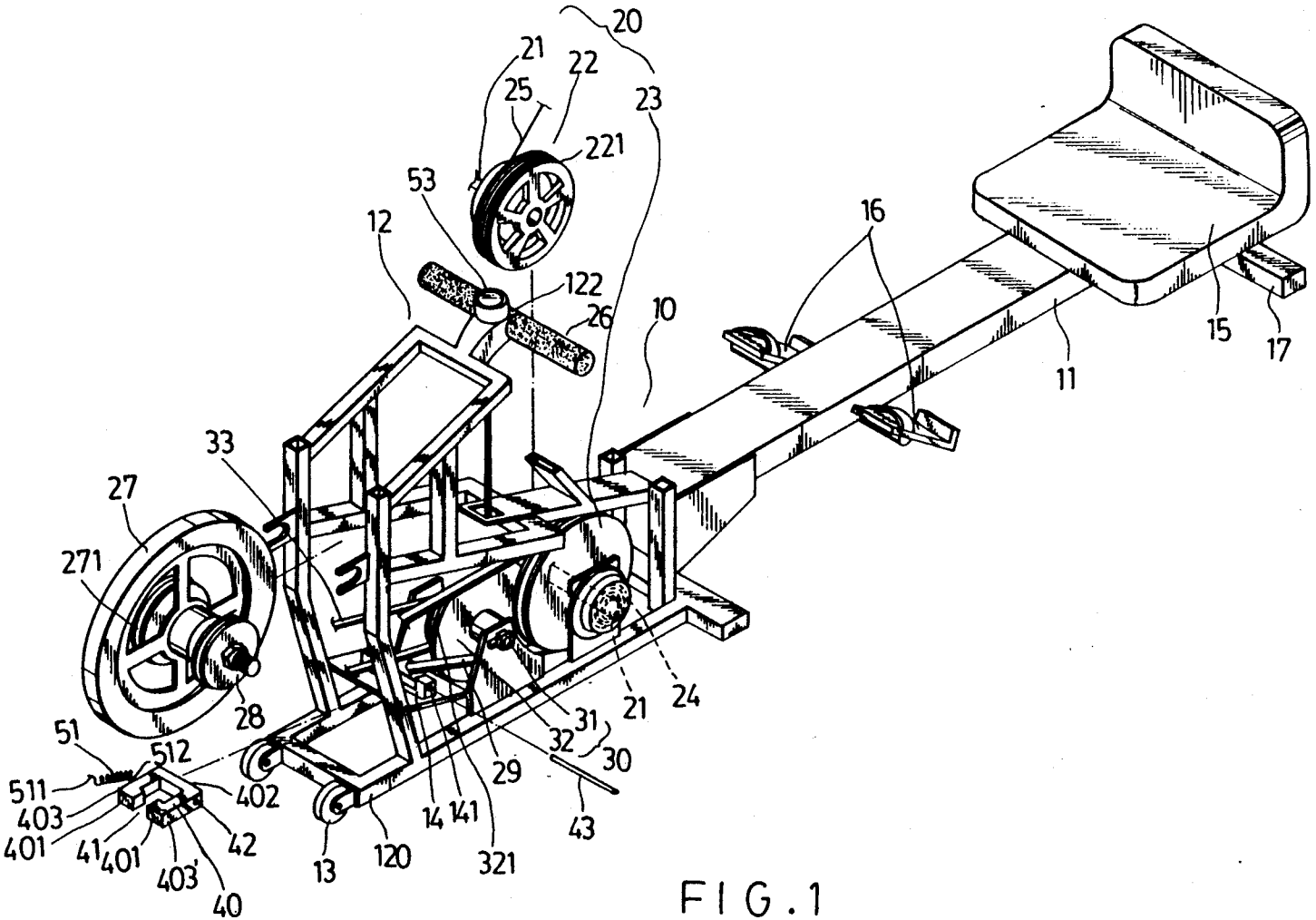
FIG. 1 is an exploded view of the preferred embodiment of a magnetic resistance type stationary rowing unit according to the present invention.

Referring to FIG. 1, the preferred embodiment of a magnetic resistance type stationary rowing unit according to the present invention is shown to generally comprise a frame assembly 10, a manually operated unit 20, and a magnetic resistance generating means 30.

The frame assembly 10 has a substantially horizontally extending body 11 and a wheel support 12 mounted on the front end of the body 11. The wheel support 12 has a base member 120 and a handle receiving portion 122 disposed on the top end of the same. Rollers 13 are provided on the front end of the base member 120 to facilitate transporting the preferred embodiment. A U-shaped upwardly standing seat 14 is mounted on the base member 120 inward from the rollers 13. The seat 14 has two upwardly extending ends provided with aligned pivot holes 141. The frame assembly 10 further includes a pair of foot rests 16 secured adjacent to the front end of the body 11, a rear leg unit 17 provided on the rear end of the body 11, and a slidable seat 15 disposed on the body 11 between the foot rests 16 and the leg unit 17.

The manually operated unit 20 includes a first rotating shaft 21 journaled on the base member 120 inward from the seat 14, a rope sheave 22 rotatably actuating the first rotating shaft 21, a first belt pulley 23 rigidly sleeved on the first rotating shaft 21, and a spiral spring 24 interconnecting the wheel support 12 and the rope sheave 22. The rope sheave 22 has a helical groove 221 along which a rope 25 is wound. One end of the rope 25 is secured to the rope sheave 22, while the other end of the rope 25 passes through the handle receiving portion 122 of the wheel support 12 and is fixed to a handle 26 removably disposed on the handle receiving portion 122. A flywheel 27 is journaled on the front end of the wheel support 12. Second and third belt pulleys 28 and 271 are rigidly sleeved on an axle of the flywheel 27 on opposite sides of the flywheel 27. A first endless belt 29 is trained between the first and second belt pulleys 23 and 28. The diameter of the first belt pulley 23 is larger than that of the second belt pulley 28.

Figure 1A:
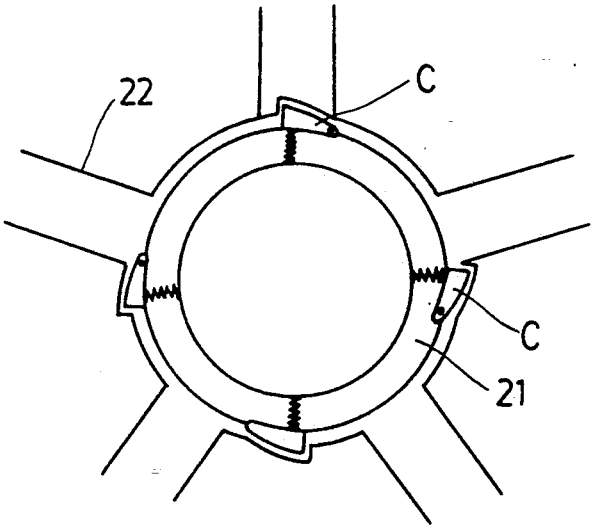
FIG. 1A is a schematic side view illustrating the connection between a rotating shaft and a rope sheave of the magnetic resistance type stationary rowing unit according to the present invention.

Referring to FIGS. 1 and 1A, when the handle 26 is pulled away from the handle receiving portion 122 of the wheel support 12, the rope 25 unwinds and the rope sheave 22 rotates clockwise. A clutch means (C) locks the rope sheave 22 on the first rotating shaft 21 to correspondingly rotate the first rotating shaft 21 and the first belt pulley 23. Rotation of the first belt pulley 23 is transmitted to the flywheel 27 via the first endless belt 29 and the second belt pulley 28. The flywheel 27 rotates faster because of the difference in the diameters of the first and second belt pulleys 23 and 28. Clockwise rotation of the first rotating shaft 21 causes the spiral spring 24 to wind. When tension on the handle 26 is relaxed, the spiral spring 24 unwinds to provide the necessary torque to wind the rope 25 around the rope sheave 22. The clutch means (C) unlocks the rope sheave 22 from the first rotating shaft 21 when the rope sheave 22 rotates in a counterclockwise direction and thus, the first rotating shaft 21 does not rotate when the rope 25 is rewound around the rope sheave 22.

The magnetic resistance generating means 30 includes a second rotating shaft 31, a rotary plate 32 and a permanent magnet 40. The second rotating shaft 31 is journaled on the base member 120 between the rope sheave 22 and the U-shaped seat 14. The rotary plate 32 is rigidly sleeved on the second rotating shaft 31. A fourth belt pulley 321 is similarly rigidly sleeved on the second rotating shaft 31 on one side of the rotary plate 32. A second endless belt 33 is trained between the third and fourth belt pulleys 271 and 321. The diameter of the fourth belt pulley 321 is smaller than that of the third belt pulley 321. Rotation of the flywheel 27 thus correspondingly rotates the rotary plate 32 at a faster pace. The rotary plate 32 should be made of an electrical conducting material such as copper or aluminum. The permanent magnet 40 is substantially U-shaped and has two inwardly extending aligned and spaced tip projections 401 disposed on the tips of the horseshoe ends. The tip projections 401 form a notch 41 therebetween and have opposite magnetic polarities. The permanent magnet 40 further has two sides 403 and 403' provided with aligned pivot through holes 42 which are disposed adjacent to the end 402 of the permanent magnet 40, opposite the tip projections 401. A pivot pin 43 extends through the pivot holes 141 and 42 to rotatably mount the permanent magnet 40 on the U-shaped seat 14. When the permanent magnet 40 is mounted on the U-shaped seat 14, the rotary plate 32 should be aligned with the notch 41, that is, the rotary plate 32 should be disposed between the tip projections 401.

Figure 2:
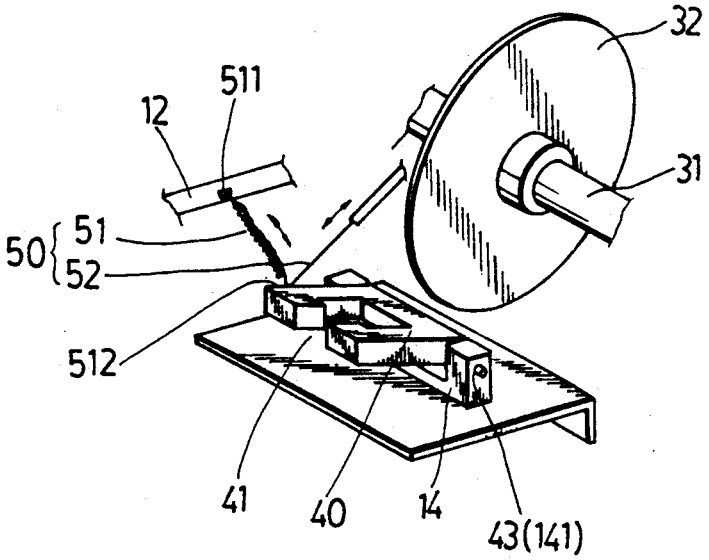
FIGS. 2 and 3 are perspective views illustrating a magnetic resistance generating means of the stationary rowing unit according to the present invention.
Figure 3:
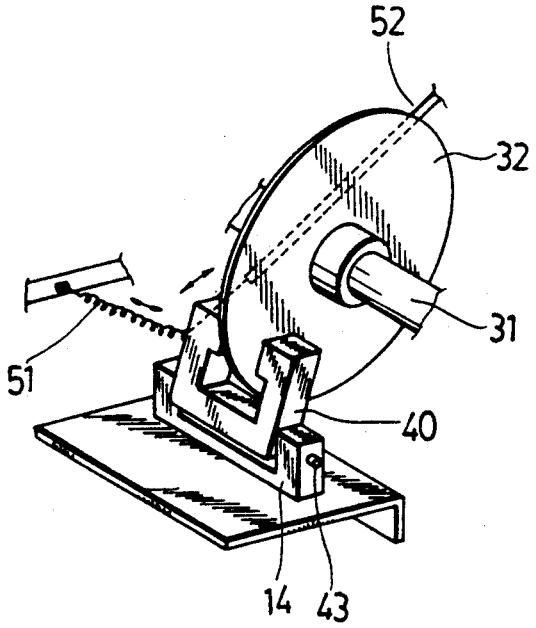

Referring to FIGS. 1 and 2, a resistance adjusting device 50 comprises a spring 51 having one end 511 connected to the wheel support 12 and the other end 512 connected to the side 403 of the permanent magnet 40. A cord 52 has one end attached to an adjusting knob 53 provided on the handle receiving portion 122 of the wheel support 12 and the other end attached to the side 403 of the permanent magnet 40. The adjusting knob 53 is operated to rotate the permanent magnet 40 about the pivot pin 43, thereby adjusting the position of the permanent magnet 40 relative to the rotary plate 32, as shown in FIG. 3.

Figure 4:
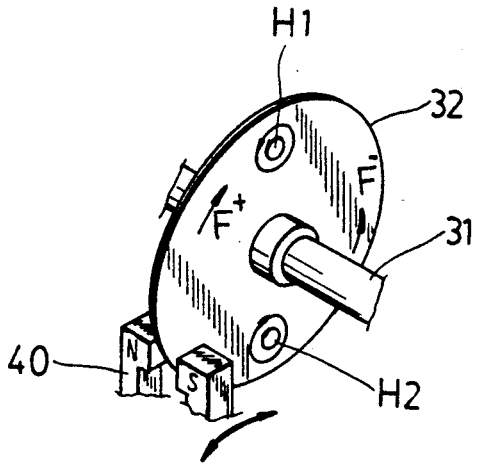
FIG. 4 is a perspective view of the magnetic resistance generating means illustrating how resistance is generated.

Referring to FIG. 4, when the preferred embodiment is in use, the rotary plate 32 cuts into a nonuniform magnetic field between the tip projections 401 of the permanent magnet 40. Electromotive forces (emfs) set up in the rotary plate 32 are greater in that part of the rotary plate 32 that is moving through the strong part of the magnetic field than in the part moving through the weaker part of the magnetic field, thereby resulting in induced eddy currents (H1) and (H2). In accordance with Lenz's law, the eddy currents (H1) and (H2) circulate in such a manner that they generate a retarding force (F−) that opposes the motion (F+) of the rotary plate 32 through the magnetic field. The retarding force (F−) is proportional to the product of the square of the flux produced by the permanent magnet 40 and passing through the rotary plate 32, and the angular velocity of the rotary plate 32. The retarding force (F−) can thus be increased or decreased by adjusting the position of the permanent magnet 40 relative to the rotary plate 32, thereby varying the amount of flux passing through the rotary plate 32. The greater the amount of flux passing through the rotary plate 32, the stronger is the retarding force (F−).

The advantages of using the preferred embodiment are as follows:

1. The retarding force (F−) decelerates the flywheel 27. Abrupt movement of the flywheel 27 is prevented, thereby prolonging the life of the preferred embodiment.

2. A wide range of retarding force (F−) can be achieved by the preferred embodiment.

3. The preferred embodiment is relatively simple in construction and is relatively inexpensive to construct.

4. The preferred embodiment is relatively quiet since no drive chains are used.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A magnetic resistance type stationary rowing unit, comprising:

a frame assembly having a substantially horizontally extending body, a wheel support mounted on a front end of said body, a seat mounted on said body, and a pair of foot rests secured on said body inward from said seat, said wheel support having a handle receiving portion disposed on a top end thereof adjacent to said body;

a manually operated unit having a first rotating shaft journaled on said wheel support of said frame assembly, and manually operated means for rotating said first rotating shaft including a rope sheave rotatably actuating said first rotating shaft and having a helical groove formed in said rope sheave, a rope wound around said rope sheave along said helical groove and having one end secured to said rope sheave, a handle secured to the other end of said rope and removably disposed in said handle receiving portion so as to rotate said rope sheave by pulling said rope away from said rope sheave, and a spiral spring connected to said rope sheave for returning said rope sheave to a static position when said rope is released;

a magnetic resistance generating means including a second rotating shaft journaled on said frame assembly, a rotary plate rigidly sleeved on said second rotating shaft and made of an electrical conducting material, and a magnet member mounted on said frame assembly adjacent to said rotary plate and having a pair of oppositely polarized and aligned ends disposed on opposite sides of said rotary plate; and endless driving means for transferring rotation of said first rotating shaft to said rotary plate;

whereby, said rotary plate cuts into a nonuniform magnetic field caused by said magnet member to thereby induce eddy currents in said rotary plate, induced eddy currents in said rotary plate generating a retarding force that opposes the motion of said rotary plate through said magnetic field.

2. The magnetic resistance type stationary rowing unit as claimed in claim 1, wherein said seat is slidably mounted on said body.

3. The magnetic resistance type stationary rowing unit as claimed in claim 1, wherein said endless driving means comprises:

a flywheel having an axle journaled on a front end of said wheel support;

a first belt pulley rigidly sleeved on said first rotating shaft;

a second belt pulley rigidly sleeved on said axle on one side of said flywheel, the diameter of said second belt pulley being smaller than that of said first belt pulley;

an endless first driving belt trained between said first and said second belt pulleys so as to transfer rotation of said first belt pulley to said flywheel;

a third belt pulley rigidly sleeved on said axle on the other side of said flywheel;

a fourth belt pulley rigidly sleeved on said second rotating shaft, the diameter of said fourth belt pulley being smaller than that of said third belt pulley; and an endless second driving belt trained between said third and said fourth belt pulleys so as to transfer rotation of said flywheel to said rotary plate;

whereby, the rotational speed of said rotary plate is faster than that of said first rotating shaft.

4. The magnetic resistance type stationary rowing unit as claimed in claim 1, wherein said manually operated rotating means further comprises a clutch means for locking said rope sheave on said first rotating shaft when said rope is pulled away from said rope sheave.

5. The magnetic resistance type stationary rowing unit as claimed in claim 1, wherein said magnet member is a permanent magnet.

6. The magnetic resistance type stationary rowing unit as claimed in claim 5, wherein said magnet member is substantially U-shaped, said oppositely polarized and aligned ends being formed as inwardly extending and spaced aligned tip projections.

7. The magnetic resistance type stationary rowing unit as claimed in claim 6, wherein said magnet member is pivotably mounted on said wheel support, said magnetic resistance type exercise unit further comprising means for adjusting the position of said magnet member relative to said rotary plate.

8. The magnetic resistance type stationary rowing unit as claimed in claim 7, wherein said adjusting means comprises an adjusting knob disposed on said handle receiving portion, and a cord having one end connected to said adjusting knob and the other end connected to said magnet member, said adjusting knob being operated to vary the position of said magnet member relative to said rotary plate.

9. The magnetic resistance type stationary rowing unit as claimed in claim 8, wherein said adjusting means further comprises means for biasing said magnet member towards said wheel support against a pulling action of said cord.

10. The magnetic resistance type stationary rowing unit as claimed in claim 1, wherein said rotary plate is made of copper.

11. The magnetic resistance type stationary rowing unit as claimed in claim 1, wherein said rotary plate is made of aluminum.

12. The magnetic resistance type stationary rowing unit as claimed in claim 1, further comprising roller means provided on a lower end of said wheel support to facilitate transporting of said exercise unit.

* * * * *